United States Patent [19]

Telnaes

[11] 4,448,419

[45] May 15, 1984

[54] ELECTRONIC GAMING DEVICE UTILIZING A RANDOM NUMBER GENERATOR FOR SELECTING THE REEL STOP POSITIONS

[76] Inventor: Inge S. Telnaes, 4435 Canyon Dr., Reno, Nev. 89509

[21] Appl. No.: 352,048

[22] Filed: Feb. 24, 1982

[51] Int. Cl.[3] ..... A63F 5/04

[52] U.S. Cl. ..... 273/143 R; 273/138 A

[58] Field of Search ..... 273/138 A, 143 R, 237, 273/143 C, 143 D, 143 E; 364/717, 412, 410

[56] References Cited

U.S. PATENT DOCUMENTS 4,095,795 6/1978 Saxton et al. ..... 273/143 R

*Primary Examiner*—Richard C. Pinkham
*Assistant Examiner*—Mary Ann Stoll
*Attorney, Agent, or Firm*—Gerald L. Moore

[57] ABSTRACT

A gaming machine of the type utilizing rotating reels (16) which carry on the periphery a plurality of indicia, a brake (19) to stop the reels at a selected position and a random number generator for selecting the reel stopping position. Numbers are assigned to the reel stopping positions and entered into the random number generator (41) with each number being entered one or more times to control the payout odds of each particular stopping position being selected thereby enabling any odds to be set without changing the physical characteristics of the machine.

10 Claims, 7 Drawing Figures

ELECTRONIC GAMING DEVICE UTILIZING A RANDOM NUMBER GENERATOR FOR SELECTING THE REEL STOP POSITIONS

FIELD OF THE INVENTION

This invention relates to gaming apparatus of the type commonly known as slot machines, wherein a plurality of reels are set into rotation and the stopping position, as indicated by indicia on the periphery of the reels, indicates the payoff to the player.

BACKGROUND OF THE INVENTION

Slot machines are gaming devices which incorporate a plurality of reels rotatable about a common axis and on which are carried at the periphery a plurality of indicia indicating the position each reel stops. Usually the reels are set into motion by pulling a lever and upon stopping, the angular positions of the reels are detected to determine the amount of payoff to the player.

In the original mechanical machines the reels were stopped by actuating a brake or a tripping arm/pin which moved into grooves (cutouts) in each reel's index wheel on a random timing basis. This method was carried over to the electromechanical machines of the 1960's and to date insofar that the basic stopping of the reels is by timewise releasing an index pin into grooves in index wheels attached to the reels with indicia displaying the game result. These varying depth grooves enabled, via physical contact closures of wipers being a part of the index arm mechanism and physical wiring to relay logic, payouts in accordance with the designed payout schedule which again was directly related to the probability of occurrence of the indicia—symbol—displayed on the reel itself. Such machines are directly susceptible to wear and tear (including erroneous electrical paths due to dirt and coin dust in particular, in the wiper contact area) as well as intentional tampering by both the player and unethical operators and their employees adversely affecting the regulations required for randomly probabilistic payoff.

Beyond the above-described slot machine devices there has followed now the electromechanical gaming devices employing a plurality of reels rotatable about a common axis and set into rotation by the pulling of a lever. However, in these newer devices an electronic random number generator of some type is energized which generates one number corresponding to each of the various positions at which the reels can be stopped. As the game is played, each reel is stopped in sequence with the other reels at a position corresponding to each subsequent number generated. The angular rotational positions of the reels are detected at all times and the brake is engaged when the reel position corresponds to the random number generated for that reel. The probability for paying off on a combination of indicia on presently used machines, as described above, is dependent on the number of reels, the number of different angular rotational positions at which the reels can be stopped, and the number of winning combinations of indicia. In other words, the lowest probability for payoff that can be offered on presently used machines are 1 to $N^R$ where N is the number of angular rotational positions on each reel and R is the number of reels. Thus, for a three reel machine having 20 stop or index positions on each reel, the lowest probability that can be offered is $1:20^3$ or 1:8000. For a machine to be commercially viable, there is a limit on the largest amount that will be paid for any such single indicia combination.

The above reasoning explains why the slot machines which offer greatly increased payoffs are usually very large machines in terms of the number of reels and stop positions. The large machine provides the physical size to allow an increase in the number of reel stop positions as well as number of reels to increase the probability against payoff on any one position.

It should be noted that the market demands higher and higher payoffs to maintain and increase player appeal, yet the casino or operator must be assured that the probability of win and payout allows for a reasonable business profit. Generally the profit-hold objectives before taxes and operational costs that are deducted are in the range as low as 2.7% and generally up to 15%. Hence, the higher payoff for a winning indicia combination must be counterbalanced with less probability for the high win combination of indicia.

It is therefore the purpose of this invention to increase the capability of the designer to include high payoffs without increased physical size of the machine and with uniform presentation of the games of different models to the player. It should be noted that the players perceive larger machines as being less "good" in terms of winning and payout chances. That is, large physical machines and a large number of reels develop an attitude in the player which affects the play and acceptance of the machine although this does not always coincide with the true mathematical reality and probability of payout of the machine. This attitude affects the play appeal of the device and its revenue-producing capability and this player's attitude is quite important in marketability of the slot machines both to casinos and operators as well as to the "player" slot location. Also, this attitude may be more influential on whether or not the machine is played than published figures showing the payoff odds. Thus, it is important to make a machine that is perceived to present greater chances of payoff than it actually has within the legal limitations that games of chance must operate.

It is a further purpose of the present invention to provide a machine on which the probability is easily designed and on which high value payoffs can be offered on a standard three or four reel machine with correct probability that makes the high value payoffs feasible. The major benefits of such a machine besides the marketability and competitiveness to other slot machines and pure electronic or video games and gaming devices are:

(1) Prevention of tampering of the game to create illegal wins and payoffs.

Note that this feature of the invention protects both the operator and more importantly, the public or player as well as the licensing agency.

(2) Standardization in design and production by cost effectiveness of the product line across all conceivable product models and payoff probabilities and odds, i.e. payback of a win for a given coin insert.

SUMMARY OF THE INVENTION

A game apparatus having a plurality of reels mounted for rotation about an axis and which can be set into motion by the pulling of a lever. Indicia are fixed to the outer peripheries of these reels to indicate reel positions and a brake is operable to stop the reels at any randomly preselected position.

A random number generator is provided with electronic circuitry which computes the random stop position at which the reel should be stopped by the physical brake. This is done with an electronically random number selected from a group of numbers which exceeds the number of physical reel positions such that one physical reel position is represented by one or several positions on the virtual or electronically generated reel which is in affect, randomly stopped by the random number generator. In this invention the physical reels are only used as a display of the random number generated result and are not the game itself as in standard slot machines. In this manner, a standard slot machine or gaming apparatus can be made to function at payout odds, independent of the limits set by the number of physical reels and their physical stop positions, by changing the random number generator.

DESCRIPTION OF THE INVENTION

Figure 1:
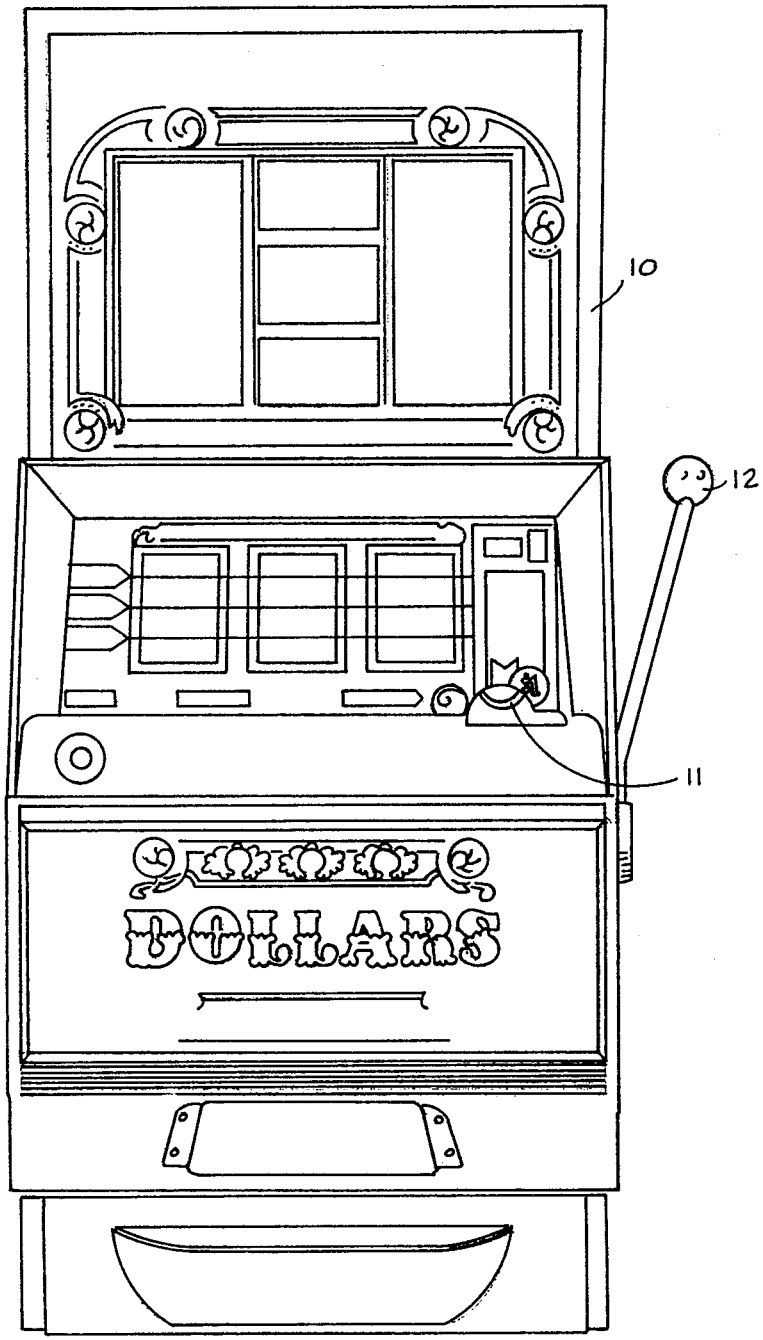
FIG. 1 shows a standard electronic slot machine in which the subject invention can be applied. This machine looks identical to the present predominant electromechanical machine on the market although it is an electronic game.
Figure 2:
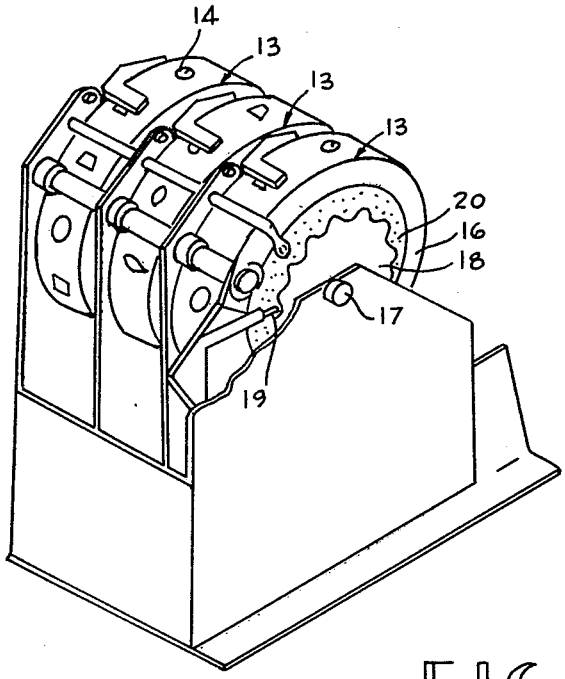
FIG. 2 is a perspective view of a typical reel mechanism of a standard gaming machine.
Figure 3:
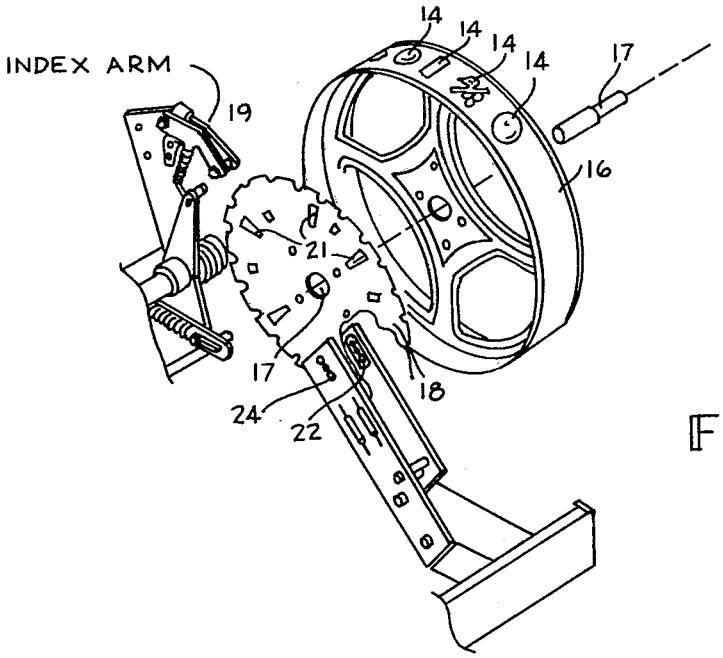
FIG. 3 shows in exploded detail a typical reel mechanism in which the invention can be applied.
Figure 4:
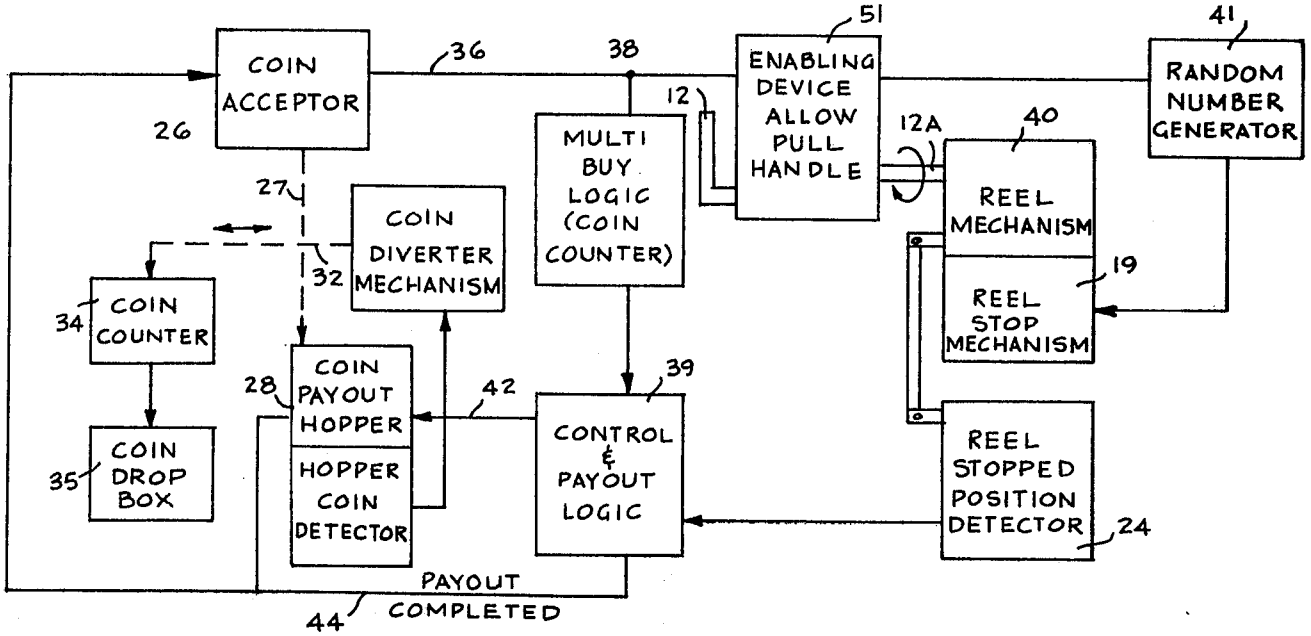
FIG. 4 is a block diagram of a prior art control system for a gaming device.

Illustrated in FIG. 1 is a standard slot machine 10 which generally is played by the insertion of tokens into slots 11 and pulling a handle 12. Each such gaming device includes a plurality of reels, such as the reels shown in FIGS. 3 and 4, having indicia 14 fixed on the periphery to indicate the radial position of each reel. The reel assembly comprises a reel body 16 mounted for rotation about a shaft 17. Fixed to the reel is an index reel 18 and an index arm 19 which fits into index grooves on the index disc to serve as a brake for stopping the reel. FIG. 4 illustrates one method of sensing the angular position of the index wheel 18 and thus the reel 16.

The index wheel 18 has openings 21 through which a light source 22 passes light to the photo detector 24. The photo detector and connected sensor circuitry sense the angular position of the reel (not shown) and provide electrical pulses to a microprocessor decode logic to indicate the reel angular position.

Figure 5:
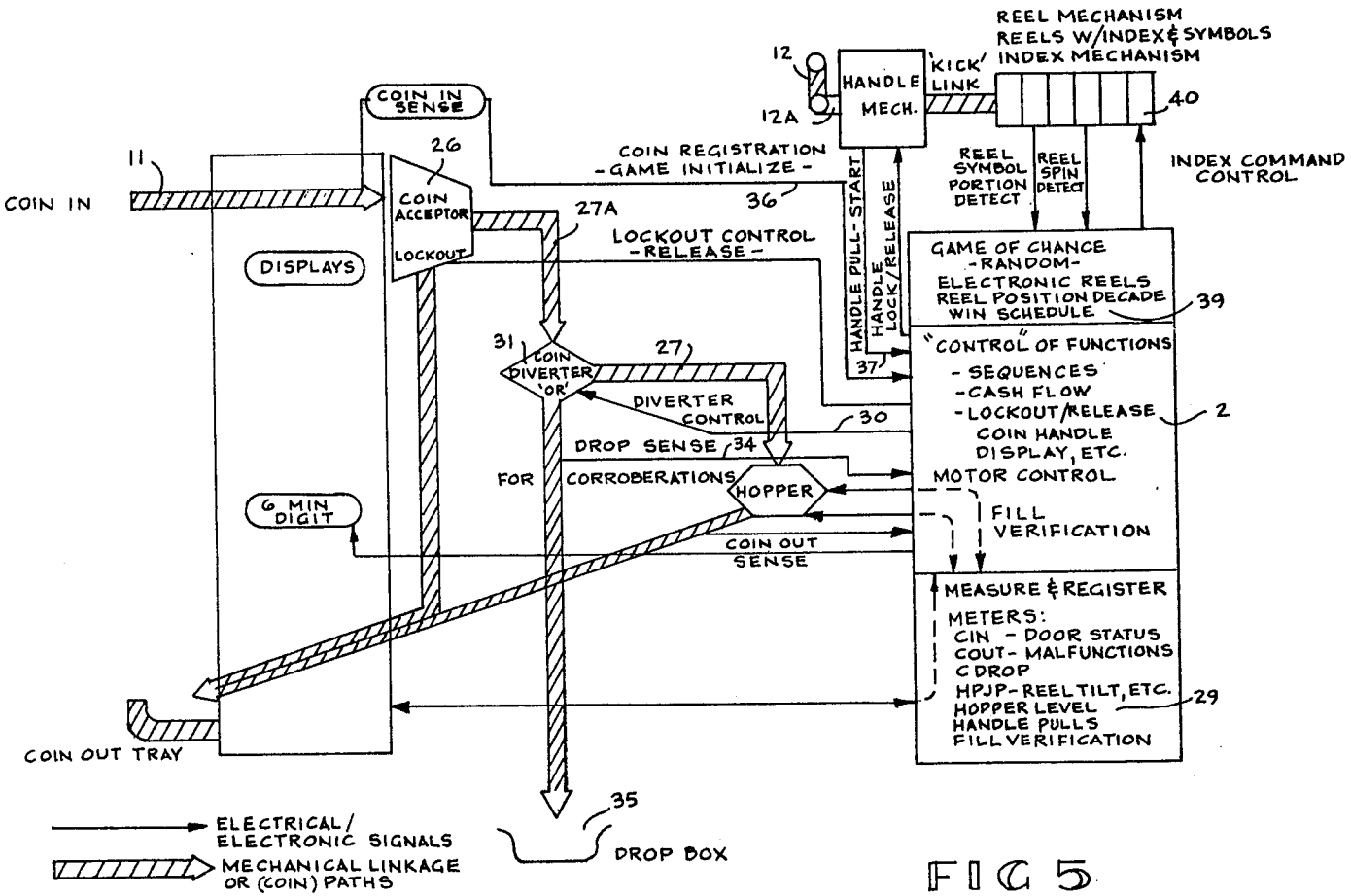
FIG. 5 shows a functional flow diagram of a gaming device in which the invention is applied.

As illustrated diagrammatically in FIGS. 1, 4, and 5, coins are inserted into the slot 11 and detected by a coin acceptor 26 (FIGS. 4 and 5). The coins pass along a conduit 27 into a coin payout hopper 28. The level of coins in the payout hopper is sensed by a detector 29 which, acting through the line 30 when the hopper 28 is full, causes the coin diverter mechanism 31 to deflect a paddle 32 and divert the coins recorded into a coin counter 34 to come to rest in a coin drop box 35. When coins have been accepted, a signal passes through the line 36 to energize the enabling device 37 and allow the handle 12 to be pulled. If multiple coins are fed into the machine a multi-buy-logic 38 detects this fact and signals the control and payout logic 39 of the number of coins inserted.

When the handle 12 is pulled, a shaft 12A is rotated to power the reel mechanism 40. A random number generator 41 is creating random numbers and at a selected position, causes the individual index arm 19 to stop each reel of the reel mechanism in order. At that time the photocell 24 signals the control and payout logic 39 the reel position and causes a signal to be passed through the line 42 indicating payout. When payout is completed, a signal passes back through the line 44 to the control and payout logic for the playing of another game.

The above indicates a standard electromechanical gaming machine in which most or several of the functions are performed by electronic circuitry. As described before, the random number generator in past devices can select a number corresponding to a reel position. The group of numbers from which the number is selected equals the number of positions at which the reel can be stopped. Thus while the indicia on the periphery of the reel may be the same at several positions, still the numbers from which selection can be made each correspond to one position of the reel. Thus the total number of combinations at which the reels can be stopped are the number of reel positions raised to the power of the number of reels or $N^3$ in the subject apparatus shown with 3 reels wherein N is the number of positions at which each reel can be stopped. As stated before the manner of increasing the odds in present machines is either by adding reels or adding reel positions to the machine. Such an act involves the mechanical disassembly of the machine and the replacement of the reel position mechanisms and the random number generator.

Figure 6:
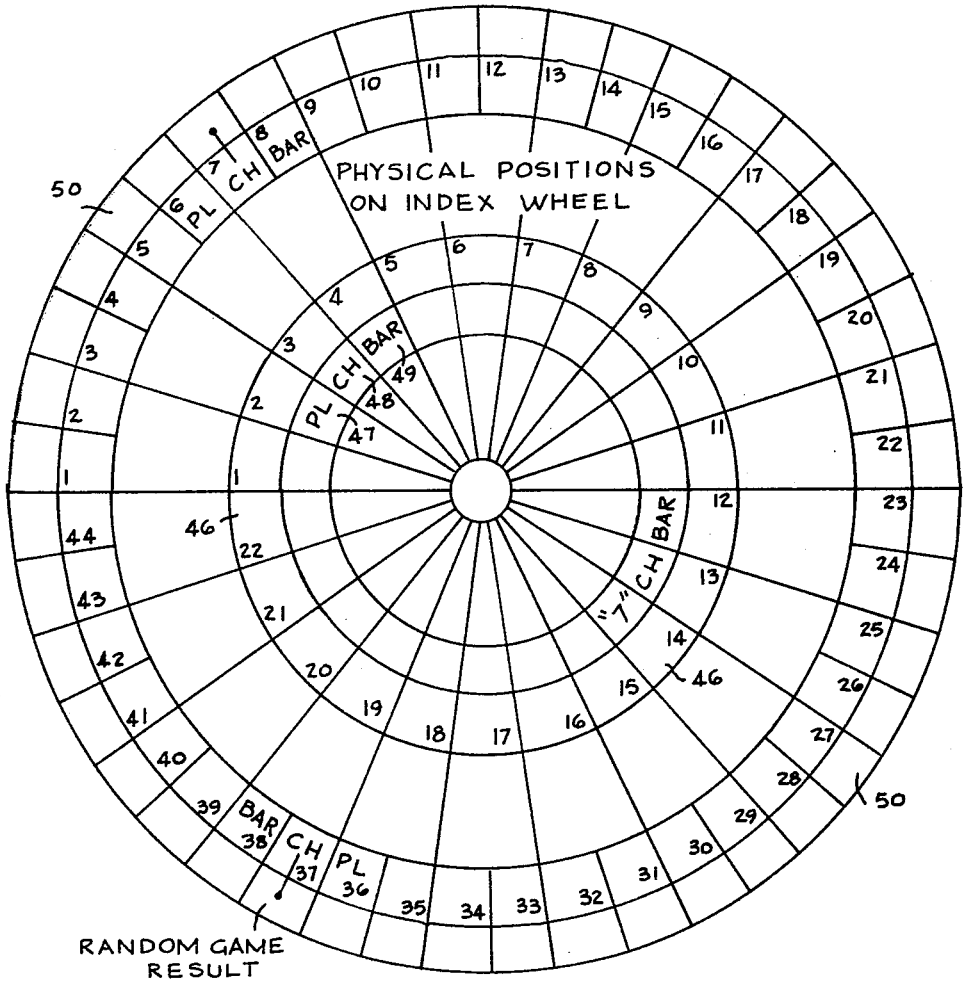
FIG. 6 shows pictorially how the symbols on a reel displayed to the player compares to the virtual electronic indicia reel generated by the electronic random number generator.
Figure 7:
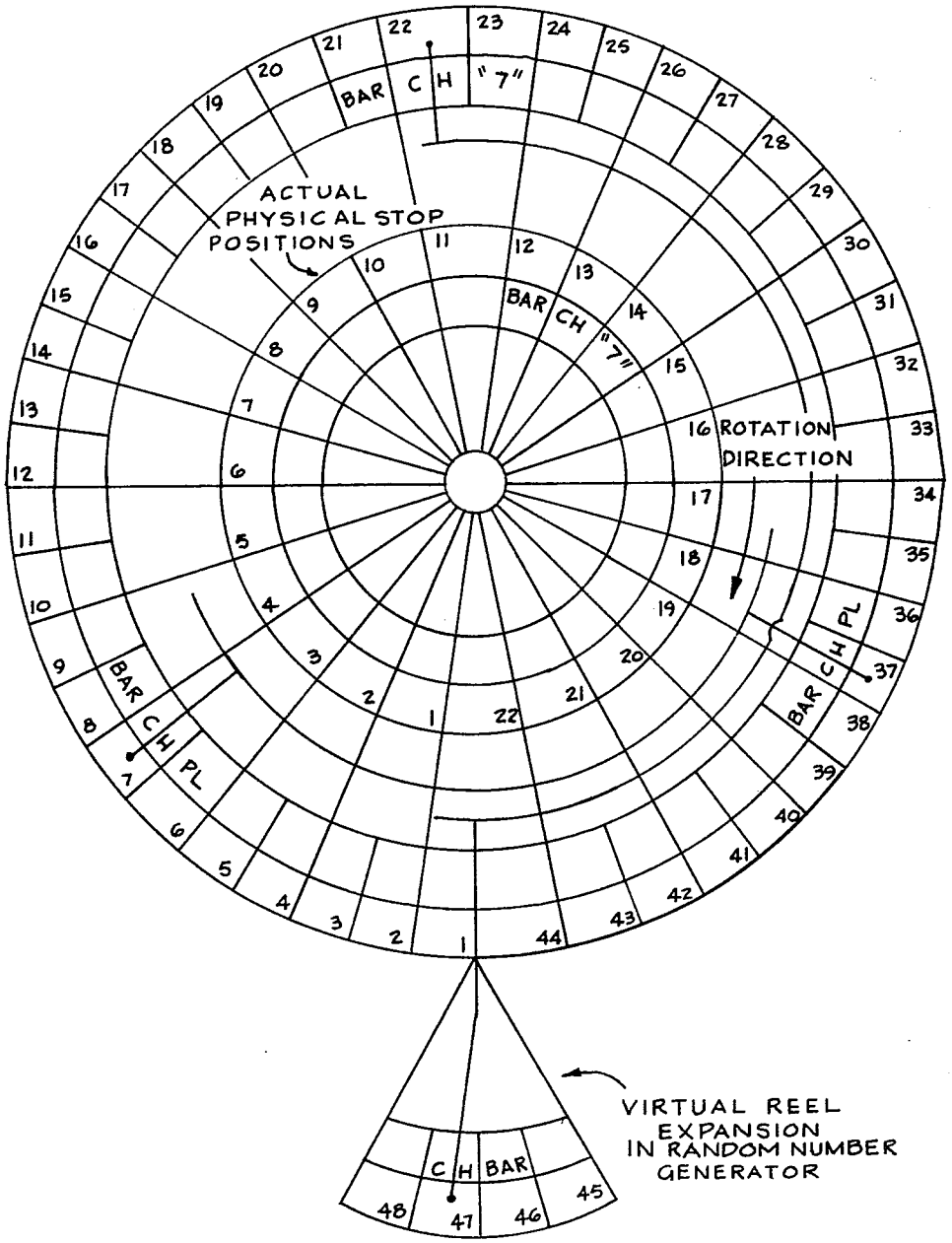
FIG. 7 shows pictorially how the invention can be applied with flexibility in design by only expanding the virtual electronic reel.

Because the players observe directly the reel setup, increasing the number of reels and the number of reel stop positions naturally decreases the player acceptance of the gaming apparatus. Also there is a physical limit to the increasing of the physical size of the machines thereby imposing a limit to the maximum jackpots that can be offered in present day machines. In accordance with the present invention, there is provided a standard gaming apparatus which can be set up to pay off at any odds with no change in the mechanical apparatus of the machine. Thus the machine can be altered easily to pay off very high jackpots with a standardized mechanical reel mechanism with the odds being accurately predictable. Accordingly as shown in FIG. 6 in diagrammatic form, one standard type of reel will include 22 positions as illustrated by the circle 46. For example, these 22 positions can include a plum 47, a cherry 48, and a bar 49. The table entry in the random number generator for this machine is illustrated by the circle 50. Note that this circle has 44 "Virtual" or "Randomly Programmed" positions. Accordingly, the positions 7,22, and 37 are assigned "cherry" thus changing the odds for hitting a cherry from 2 out of 22 or 0.0909 to 3 out of 44 or 0.0681. Thus by changing the number of "Virtual" positions in the read only memory without altering in any manner the standard 22 position reel, the odds on cherry can be changed dramatically. Such is possible because more positions are included in the read only memory than are included on the mechanical reel, a departure from past machines wherein the random number generator table has included only the reel positions.

Since the general requirements for gaming devices are that the reel be able to stop at all positions displayed and the controls be such that they can cause the reel to stop at all positions displayed, the only way that the odds can be changed is by increasing the number of symbol positions in the read only memory. In the past such odds were changed by adding physical reels or reel positions, a time-consuming act which is not necessary with the subject invention wherein the reel mechanism can be standardized for all payoff levels. It is stressed that the described invention not only offers a marketing advantage in providing for flexibility in design and the ability to give high win odds with present twenty, twenty two, or twenty five mechanical stop mechanisms with few reels (1,2,3, or 4), but also provides the manufacturer with significant economic benefits in manufacturing such as:

(1) The read only memory used for the virtual reels' stop positions are only limited by the designer's imagination in the present technology. However, the invention allows all products—slot machines—to be physically produced with the same reel size and stop position capability without any mechanical change (in design, production, etc.). This greatly simplifies tooling, service, maintenance, service training, and spare parts requirements, etc.

(2) In addition, the invention now also enables independent "Virtual" reel probability design, although the physical reels all are alike, which presents a new dimension to the game of chance design.

I claim:

1. A game apparatus, comprising:

a reel mounted for rotation about an axis through a predetermined number of radial positions;

means to start rotation of said reel about said axis;

indicia fixed to said reel to indicate the angular rotational position of said reel;

means for assigning a plurality of numbers representing said angular positions of said reel, said plurality of numbers exceeding said predetermined number of radial positions such that some rotational positions are represented by a plurality of numbers;

means for randomly selecting one of said plurality of assigned numbers; and means for stopping said reel at the angular position represented by said selected number.

2. A game apparatus as defined in claim 1 including a multiplicity of reels mounted for rotation.

3. A game apparatus as defined in claim 1 wherein some angular rotational positions only have one number representing that position.

4. A game apparatus as defined in claim 1 wherein said means for randomly selecting is a random number generator.

5. A game apparatus as defined in claim 4 wherein said means to start rotation of said reel is a lever.

6. A game apparatus as defined in claim 1 including a plurality of reels and said means for stopping stops said reels in a predetermined sequence.

7. A game apparatus as defined in claim 6 wherein said means for randomly selecting one of said assigned numbers does so for each reel.

8. A game apparatus, comprising:

a plurality of reels mounted for rotation about an axis:

indicia fixed to said reel peripheries to identify each of a randomly predetermined number of rotational positions through which said reels rotate;

means to stop each said reel at any selected one of said positions;

a random number generator for selecting one number from a plurality of numbers each representing one of said different angular rotational positions, said plurality of numbers exceeding the number of rotational positions of said reel such that a plurality of numbers represents some of the reel positions; and means to set said reels into rotation and to energize said random number generator.

9. The method of controlling the win odds on a game apparatus having at least one reel rotatable through a plurality of positions and stoppable at any one of said plurality of positions with the positions having differing rewards, said method comprising the steps of:

assigning to each position at least one of a plurality of numbers;

entering said plurality of numbers in a random number generator;

starting said random number generator and reel and stopping said reel at the number selected by said random number generator; and assigning a different quantity of numbers to each position to obtain the win odds desired.

10. The method of controlling the win odds on a game apparatus wherein a plurality of indicia are displayed and the reward is based on which indicia is selected, said method comprising the steps of:

assigning a plurality of numbers to most indicia and assigning at least one number to all indicia;

entering said numbers into a random number generator;

operating said random number generator to select one of said numbers;

displaying the indicia represented by said number; and selecting the quantity of numbers to be assigned to each indicia responsive to the total quantity of numbers entered into said random number generator to make the win odds on each indicia a desired value.

* * * * *